US008842843B2

(12) United States Patent
Emori et al.

(10) Patent No.: US 8,842,843 B2
(45) Date of Patent: Sep. 23, 2014

(54) SIGNAL CORRECTION APPARATUS EQUIPPED WITH CORRECTION FUNCTION ESTIMATION UNIT

(75) Inventors: Tadashi Emori, Tokyo (JP); Masanori Tsujikawa, Tokyo (JP)

(73) Assignee: NEC Corporation, Tokyo (JP)

( * ) Notice: Subject to any disclaimer, the term of this patent is extended or adjusted under 35 U.S.C. 154(b) by 482 days.

(21) Appl. No.: 13/129,646

(22) PCT Filed: Sep. 3, 2009

(86) PCT No.: PCT/JP2009/004340

§ 371 (c)(1),
(2), (4) Date: May 17, 2011

(87) PCT Pub. No.: WO2010/061506

PCT Pub. Date: Jun. 3, 2010

(65) Prior Publication Data

US 2011/0225439 A1 Sep. 15, 2011

(30) Foreign Application Priority Data

Nov. 27, 2008 (JP) ..... 2008-302243

(51) Int. Cl.
*H04R 29/00* (2006.01)
*H04R 3/00* (2006.01)
*G10L 21/02* (2013.01)

(52) U.S. Cl.
CPC ..... *H04R 3/005* (2013.01); *G10L 21/02* (2013.01)
USPC ..... 381/56; 381/104; 381/107; 381/122

(58) Field of Classification Search
None
See application file for complete search history.

(56) References Cited

U.S. PATENT DOCUMENTS

| | | | | |
|---|---|---|---|---|
| 7,327,852 | B2 * | 2/2008 | Ruwisch | 381/356 |
| 2006/0053003 | A1 * | 3/2006 | Suzuki et al. | 704/216 |
| 2007/0053455 | A1 * | 3/2007 | Sugiyama | 375/260 |
| 2011/0202339 | A1 * | 8/2011 | Emori et al. | 704/231 |

FOREIGN PATENT DOCUMENTS

| | | | |
|---|---|---|---|
| JP | 2005-57400 | A | 3/2005 |
| JP | 2007-68125 | A | 3/2007 |
| JP | 2008-164747 | A | 7/2008 |
| JP | 2008-164747 | A * | 12/2008 |

OTHER PUBLICATIONS

Lingvall, Fredrik, and Lars-Johan Brannmark. "Multiple-point statistical room correction for audio reproduction: Minimum mean squared error correction filtering." J. Acoust. Soc. Am. 125.4 (2009): 2121-28. IEE.*

* cited by examiner

*Primary Examiner* — Joseph Saunders, Jr.
*Assistant Examiner* — James Mooney
(74) *Attorney, Agent, or Firm* — Sughrue Mion, PLLC

(57) ABSTRACT

A signal correction apparatus receives an input audio signal (serving as a first sound reception means). The signal correction apparatus computes, at every frequency, first power that indicates magnitude of sound represented by the input audio signal (serving as a first power computation means). The signal correction apparatus estimates a correction function that is a continuous function defining a relation between each frequency and a correction coefficient used to approximate the first power computed at that frequency to the reference power predetermined for that frequency (serving as a correction function estimation means). The signal correction apparatus multiplies the computed first power by the correction coefficient acquired in accordance with the relation defined by the estimated correction function so as to correct the first power at every frequency (serving as a power correcting means).

12 Claims, 4 Drawing Sheets

SIGNAL CORRECTION APPARATUS EQUIPPED WITH CORRECTION FUNCTION ESTIMATION UNIT

CROSS REFERENCE TO RELATED APPLICATIONS

This application is a National Stage of International Application No. PCT/JP2009/004340 filed Sep. 3, 2009, claiming priority based on Japanese Patent Application No. 2008-302243, filed Nov. 27, 2008, the contents of all of which are incorporated herein by reference in their entirety.

FIELD OF THE INVENTION

The present invention relates to a signal correction apparatus for correcting an input audio signal.

BACKGROUND ART

Sound signal processing systems are well-known in the art that have a plurality of microphones and receives audio signals input via the microphones. As is prone to be with this type of the sound signal processing systems, when input through the microphones, the same sound appears different in power that indicates magnitude of the sound represented by an audio signal received through each of the microphones (i.e., power of the audio signal) because of dissimilarities inherent to the microphones, different degrees of deterioration over time, divergent types of signal transmission system (e.g., wiring), and the like.

Thus, this type of the sound signal processing systems employ a signal correction apparatus that predetermines, for each frequency, a correction coefficient used for approximating the power of the audio signal received via each of the microphones to the reference power and then uses the predetermined correction coefficient to correct the power of the audio signal received via each of the microphone (e.g., see Patent Document 1 listed below).

Such a signal correction apparatus receives the audio signal input via a certain one of the microphones and computes the power of the received audio signal at every frequency. Then, the signal correction apparatus computes, for each frequency, a rate of the reference power used as a criteria (e.g., an average of all the values of the power obtained for each of the microphones) to the computation result for the power of the audio signal so as to determine in advance the correction coefficient according as the computed rate. After that, the signal correction apparatus corrects the power of the received audio signal based upon the predetermined correction coefficient. In this manner, the received audio signal can have its power approximated to the reference power at each frequency.

Patent Document 1

Official Gazette of Preliminary Publication of Unexamined Japanese Patent Application No. 2007-68125

SUMMARY

In the above-mentioned signal correction apparatus, sometimes an audio signal of input power excessively higher (or excessively lower) at a certain frequency than at any other frequency is input for some reason (e.g., the input audio signal is superimposed with noise, or a delay time associated with propagation of the input audio signal is redundant). In such a case, the correction coefficient determined for such excessive frequency should be excessively smaller (or excessively larger). This unable the power of the received audio signal at such frequency to fully approximate to the reference power.

Accordingly, it is an object of the present invention to provide a signal correction apparatus that can be a solution to the aforementioned problem in the prior art that it is impossible 'to fully approximate power of an input audio signal to the reference power.'

To fulfill the object of the present invention, a signal correction apparatus in one aspect of the present invention comprises:

a first sound reception means for receiving an audio signal, a first power computation means for computing, at every frequency, first power that indicates magnitude of sound represented by an audio signal, based upon the audio signal received by the first sound reception means, a correction function estimation means for estimating a correction function that is a continuous function defining a relation between each frequency and a correction coefficient used to approximate the computed first power at that frequency to the reference power predetermined for that frequency, and a power correcting means multiplying the computed first power by the correction coefficient obtained in accordance with the relation defined by the estimated correction function, for correcting the first power at every frequency.

A signal correction method in another aspect of the present invention comprises:

computing, at every frequency, first power that indicates magnitude of sound represented by an audio signal, based upon the audio signal received by a first sound reception means for receiving an input audio signal, estimating a correction function that is a continuous function defining a relation between each frequency and a correction coefficient used to approximate the computed first power at that frequency to the reference power predetermined for that frequency, and multiplying the computed first power by the correction coefficient obtained in accordance with the relation defined by the estimated correction function, for correcting the first power at every frequency.

In still another aspect of the present invention, a signal correction program comprises instructions for causing an information processing device to realize:

a first power computation means for computing, at every frequency, first power that indicates magnitude of sound represented by an audio signal, based upon the audio signal received by a first sound reception means for receiving an input audio signal, a correction function estimation means for estimating a correction function that is a continuous function defining a relation between each frequency and a correction coefficient used to approximate the computed first power at that frequency to the reference power predetermined for that frequency, and a power correcting means multiplying the computed first power by the correction coefficient obtained in accordance with the relation defined by the estimated correction function, for correcting the first power at every frequency.

Configured in the aforementioned manner, the signal correction apparatus of the present invention is capable of correcting the power of the input audio signal so as to precisely approximate the power of the audio signal to the reference power.

EMBODIMENT

Embodiments of a signal correction apparatus, a signal correction method, and a signal correction program in accordance with the present invention will now be described with reference to the accompanying drawings of FIGS. 1 to 4.

Embodiment 1

Figure 1:
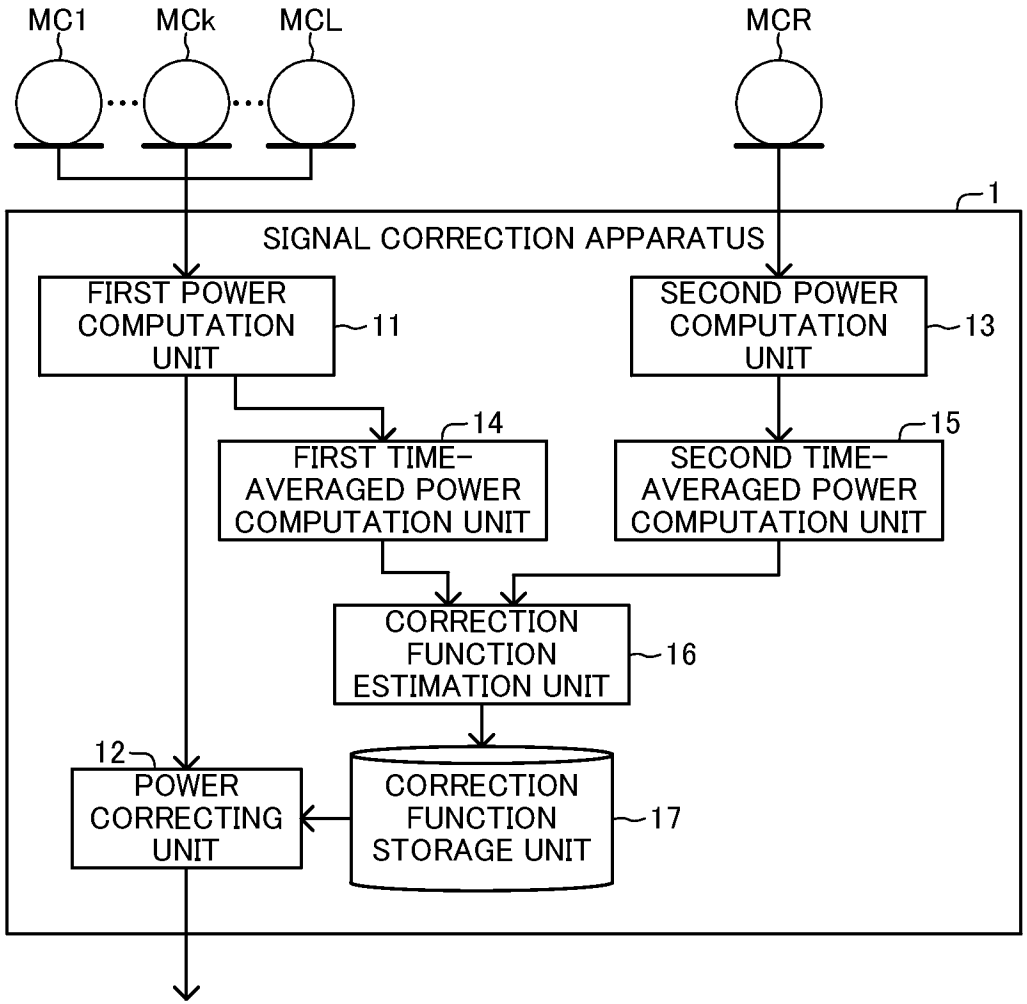
FIG. 1 is a schematic block diagram illustrating various functions of a first embodiment of a signal correction apparatus according to the present invention.

As shown in FIG. 1, a signal correction apparatus 1 in a first embodiment of the present invention is an information processing device. The signal correction apparatus 1 is comprised of a central processing unit CPU (not shown), data storage devices (a memory and a hard disk drive HDD), and an input device.

The input device is connected to a plurality (in this embodiment, L+1 in number where L is an integer) of microphones, MC1, MC2, . . . , MCk, . . . , MCL, and MCR (herein k is an integer varied from 1 to L). The microphones collect ambient sound and produce an audio signal representing the collected sound to the input device. The input device receives the audio signal produced by each of the microphones. The input device and the microphones MC1 to MCL, and MCR constitute a sound reception means. The input device and the microphone MCk constitute a first sound reception means. In addition, the input device and the microphone MCR constitutes a second sound reception means.

The signal correction apparatus 1 configured as in the above has functions implemented by the CPU's executing a program as detailed below and depicted in the flow chart of FIG. 2. Alternatively, these functions may be implemented by hardware such as logic circuits.

The signal correction apparatus 1 behaves similarly to all the plurality of the microphones MC1 to MCL. Thus, functional and operational features of the signal correction apparatus 1 in association with arbitrary one MCk of all the microphones MC1 to MCL will be discussed below.

The signal correction apparatus 1 is comprised of function means such as a first power computation unit (first power computation means) 11, a first power correcting unit (first power correction means) 12, a second power computation unit (second power computation means) 13, a first time-averaged power computation unit (first time-averaged power computation means) 14, a second time-averaged power computation unit (second time-averaged power computation means) 15, a correction function estimation unit (correction function estimation means) 16, and a correction function storage unit (correction function storage means) 17.

The first power computation unit 11 performs A/D (analog-digital) conversion of an audio signal input through the microphone MCk to convert the audio signal from analog signal into digital signal.

Furthermore, the first power computation unit 11 divides the A/D converted audio signal into signal fragments of a predetermined frame interval (at a uniform frame interval in this embodiment). The first power computation unit 11 performs an operation as detailed below for each of the signal fragments (i.e., each frame signal) of the divided audio signal.

The first power computation unit 11 performs predetermined preprocesses for each frame signal (e.g., pre-emphasis processing, multiplication by a window function, and the like). After that, the first power computation unit 11 performs fast Fourier transformation operation for each frame signal to acquire a limited frame signal (a complex number containing real and imaginary number components) in some frequency range.

At every frequency, the first power computation unit 11 produces as the power (first power) the sum of values resulting from squaring the real and imaginary number components of the frame signal acquired in the previous processing.

For instance, in the case of using a digital signal that is a signal sampled at frequency rate of 44.1 kHz and 16-bit quantified, FFT processing on 1024 sampling points at a frame interval of 10 ms results in the power $x_i(t)$ being produced every 43 Hz where i is a number corresponding to the frequency (in this embodiment, incrementing i by one is corresponding to increasing the frequency by approximately 43 Hz), and t is a number representing a position of each frame signal on the time basis (e.g., a frame number specifying each frame).

In this way, the first power computation unit 11 divides the audio signal received through the microphone MCk into signal fragments of a predetermined frame interval, and then computes, at every frequency, the first power of each of the signal fragments (i.e., each frame signal) of the divided audio signal.

The power correcting unit 12 performs, at every frequency, an arithmetic operation of multiplying the power $x_i(t)$ produced from the first power computation unit 11 by a correction coefficient f, stored in the correction function storage unit 17 so as to correct the input power $x_i(t)$. Then, the power correcting unit 12 produces a corrected power $x'_i(t)$.

In this embodiment, the correction coefficient $f_i$ is a value acquired in accordance with a relation defined by the correction function. The correction function is a continuous function defining a relation of the number i corresponding to a certain frequency (i.e., i designates the frequency) with the correction coefficient $f_i$ used to approximate the power $x_i(t)$ computed at that frequency to the reference power predetermined for that frequency. In this embodiment, the correction function is a polynomial function dealing with a variable of the frequency. As mentioned later, the correction function is estimated by the second power computation unit 13, the first time-averaged power computation unit 14, the second time-averaged power computation unit 15, and the correction function estimation unit 16.

The second power computation unit 13 has the similar functions to those of the first power computation unit 11. Based upon an audio signal received via the microphone MCR serving as the reference microphone, the second power computation unit 13 computes, at every frequency, second power $y_i(t)$ that indicates magnitude of sound represented by the audio signal.

The first time-averaged power computation unit 14 computes a first time-averaged power $x_i$ (i.e., a mean value of values of $x_i(t)$ with regard to the varied values of t) at every frequency where the first time-averaged power is obtained by means of averaging a controlled number of values of the power $x_i(t)$ computed on each frame signal in relation with a predetermined averaging time T among all the values of the first power $x_i(t)$ computed by the power computation unit 11 (i.e., the values of the power computed on all the signal fragments of a uniform frame interval resulting from division of the audio signal).

The first time-averaged power x, exists as many as half the sampling points for the FFT processing, namely, N in number. For instance, in the case of performing the FFT processing on 1024 sampling points, the number N is 512 or N=512. This means that there are 512 of the values of the first time-averaged power $x_i$, such as $x_0, x_1, x_2, \ldots, x_{511}$.

The second time-averaged power computation unit 15 have the similar functions to those of the first time-averaged power computation unit 14; that is, the second time-averaged power computation unit 15 computes, at every frequency, second time-averaged power (reference power) $y_i$ that is a mean value of a controlled number of values of the power $y_i(t)$ computed on each frame signal in relation with the predetermined averaging time T among all the values of the second power $y_i(t)$ computed by the second power computation unit 13.

The correction function estimation unit 16 estimates a correction function defining a relation of each frequency with the correction coefficient $f_i$ used to approximate the first time-averaged power $x_i$ computed by the time-averaged power computation unit 16 to the second time-averaged power or the reference power determined by the second time-averaged power computation unit 15 for that frequency.

Specifically, the correction function estimation unit 16 computes a matrix A in terms of the formula (1) as follows.

[formula 1]

$$A = \begin{pmatrix} \sum_{i=1}^{N} x_i^2 i^{2M} & \sum_{i=1}^{N} x_i^2 i^{2M-1} & \cdots & \sum_{i=1}^{N} x_i^2 i^{M} \\ \sum_{i=1}^{N} x_i^2 i^{2M-1} & \ddots & \ddots & \vdots \\ \vdots & \ddots & \ddots & \vdots \\ \sum_{i=1}^{N} x_i^2 i^{M} & \cdots & \cdots & \sum_{i=1}^{N} x_i^2 i^{0} \end{pmatrix} \quad (1)$$

The correction function estimation unit 16 uses, as the variable $x_i$ in each of the terms in the matrix A in the formula (1), the first time-averaged power $x_i$ computed by the first time-averaged power computation unit 14. M is an order of the correction function. M is a predetermined value. Preferably, M is a value varied from 0 to 20.

Moreover, the correction function estimation unit 16 computes a vector b in terms of the formula (2) as follows.

[formula 2]

$$b = \begin{pmatrix} \sum_{i=1}^{N} x_i y_i i^{M} \\ \sum_{i=1}^{N} x_i y_i i^{M-1} \\ \vdots \\ \sum_{i=1}^{N} x_i y_i i^{0} \end{pmatrix} \quad (2)$$

The correction function estimation unit 16 uses, as the variable $y_i$ in each of the component coordinates representing the vector b, the second time-averaged power (reference power) $y_i$ computed by the second time-averaged power computation unit 15.

Then, the correction function estimation unit 16 computes a vector a based on the matrix A and the vector b respectively computed in the previous steps and the formula (3) as follows, where the vector a is represented as vector

[formula 3]

$$Aa=b$$

Furthermore, the correction function estimation unit 16 computes the correction coefficient $f_i$ at every frequency based on the computed vector a and the following formula (4). The formula (4) represents a correction function that is a polynomial function with regard to a variable of the number i corresponding to each frequency (i.e., i designates the frequency). In other words, computing the vector a correlates with estimating the correction function.

[formula 4]

$$f_i = \sum_{j=0}^{M} a_j i^j \quad (4)$$

The correction function storage unit 17 correlates the correction coefficient $f_i$ computed by the correction function estimation unit 16 with the number i corresponding to each frequency so as to store the results in the data storage device.

As mentioned above, the power correcting unit 12 corrects the power $x_i(t)$ computed by the first power computation unit 11, based upon the following formula (5). Specifically, the input power correcting unit 12 multiplies the power $x_i(t)$ produced from the input power computation unit 11 by the correction coefficient $f_i$ stored in the correction function storage unit 17 so as to correct the power $x_i(t)$ itself at every frequency. Thus, the power correcting unit 12 produces the corrected power $x'_i(t)$.

[formula 5]

$$x'_i(t)=f_i x_i(t) \quad (5)$$

The formulae (1) to (3) are derived from obtaining the vector a according to which the sum of all the values, over a predetermined frequency range (in this embodiment, a range covering all the varied values of the number i corresponding to the frequency), resulting from squaring the difference between the corrected first power $x'_i$ and the second time-averaged power $y_i$ (reference power) computed by the second time-averaged power computation unit 15 is minimal.

In this way, it is possible to enlarge the frequency range that enables the power of the received audio signal to fully approximate to the reference power.

More specifically, the formulae (1) to (3) are derived from finding formulae of partially differentiating the function of squaring the difference between the reference power $y_i$ and the corrected first power $x'_i$ ($=f_i x_i$) with respect to each coefficient $a_j$ of the correction function (herein, j is an integer varied from 0 to M), equalizing the formulae to zero to obtain M+1 equations, and uniting them in a set of simultaneous equations.

Then, the aforementioned operation of the signal correction apparatus 1 will be detailed below.

Figure 2:
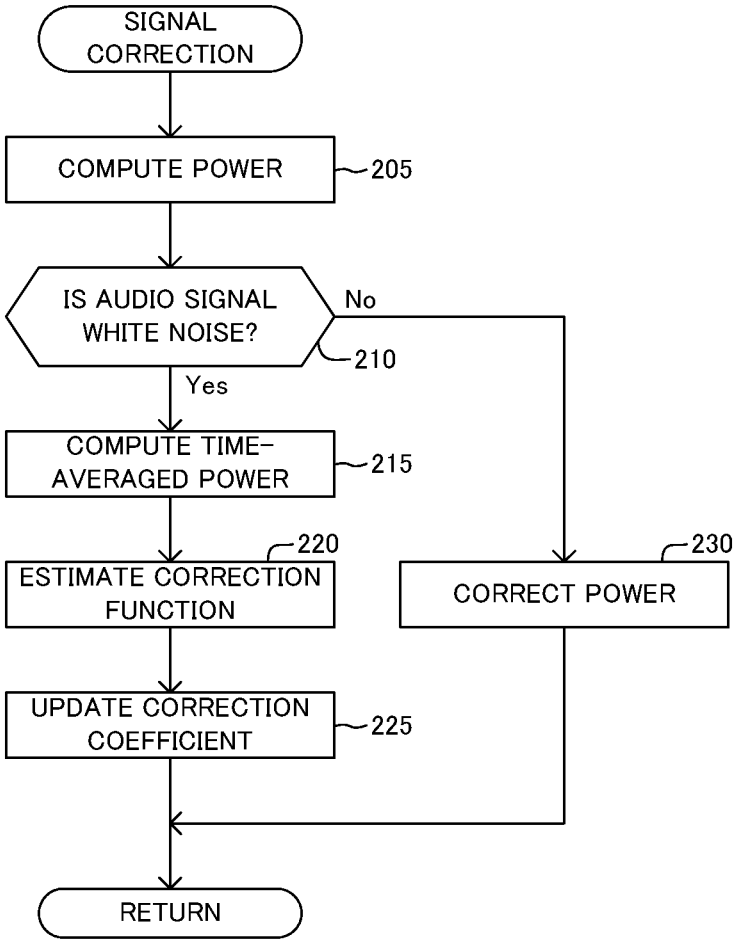
FIG. 2 is a flow chart illustrating a signal correction program executable by the CPU of the signal correction apparatus shown in FIG. 1.

The CPU of the signal correction apparatus 1 executes a signal correction program illustrated in the flow chart of FIG. 2 each time the audio signal is received via the microphone MCk.

Specifically, once the signal correction program is initiated, the CPU divides each of the received audio signal into signal fragments of a predetermined frame interval, and thereafter, it performs an arithmetic operation of computing the power (first power) $x_i(t)$ of each of the signal fragments (i.e., each frame signal) of the divided audio signal at Step 205 (first power computation step).

At step 210, the CPU determines whether or not each of the received audio signals is an audio signal representing white noise.

The following discussion is continued, assuming that the received audio signal is the one representing white noise. In such a case, the signal correction apparatus 1 performs a correction function estimation process (a process of updating the correction coefficient $f_i$ stored in the data storage device).

Specifically, the CPU passes an affirmative judgment 'YES' to proceed to Step 215. Then, the CPU performs a time-averaged power computation process for producing the first time-averaged power $x_i$ that is an average of a controlled number of values of the first power $x_i(t)$ computed for each frame signal over an averaging time T among all the values of the first power $x_i(t)$ computed at Step 205 (i.e., the power computed for each of the signal fragments derived from dividing the audio signal into signal fragments of a determined frame interval), and performing this process at every frequency (first time-averaged power computation step).

Based upon an audio signal received via the microphone MCR, the CPU also computes, at every frequency, the second power $y_i(t)$ that indicates magnitude of sound represented by the audio signal (second power computation process). In addition, the CPU computes, at every frequency, the second time-averaged power $y_i$ that is a mean value of a controlled number of values of the power $y_i(t)$ produced for each of the frame signals over the averaging time T among all the computed values of the second power $y_i(t)$ (second time-averaged power computation process).

Then, at Step 220, the CPU carries out an operation of estimating the correction function based on the first time-averaged power $x_i$ and second time-averaged power $y_i$ computed in the previous step. More specifically, the CPU carries out the operation of computing the vector a in terms of the aforementioned formulae (1) to (3) (correction function estimation step).

Next, at Step 225, the CPU performs an operation of computing the correction coefficient $f_i$ based on the vector a computed in the previous step. If the correction coefficient $f_i$ has already been stored in the data storage device, the CPU updates the correction coefficient $f_i$ by replacing the one already stored with the one most recently computed. Reversely, if the correction coefficient $f_i$ has not been stored in the data storage device (i.e., the correction coefficient $f_i$ is computed for the first time), the CPU stores the correction coefficient $f_i$ currently obtained through the computation operation.

The following discussion is on the assumption that the received audio signal is not the one representing white noise. In this case, the signal correction apparatus 1 performs an operation of correcting the power of the audio signal received through the microphone MCk.

Specifically, at Step 210, the CPU passes a negative judgment 'NO' and proceeds to Step 230, and then, carries out an operation of multiplying the power $x_i(t)$ computed at the previous step 205 by the coefficient $f_i$ stored in the data storage device, performing the same input power correcting operation at every frequency (i.e., covering every one of the varied values of the number i corresponding to the frequency) (power correcting step). Then, the CPU produces the corrected power $x'_i(t)$.

As has been described, in the first embodiment of the present invention, the signal correction apparatus 1 estimates the correction function defining a relation between each frequency and the correction coefficient $f_i$, and thereafter, it multiplies a value of the power representing magnitude of sound represented by each audio signal (the power of the audio signal) by the correction coefficient $f_i$ predetermined from the estimated correction function so as to correct the power.

In this way, even if the received audio signal has input power excessively greater at a certain frequency than any other frequency for some reason or other, the power (first power) of the audio signal can be fully approximated to the reference power.

Thus, configured in the aforementioned manner, the signal correction apparatus is able to approximate the power of the received audio signal to the reference power with the enhanced precision by means of correcting the power of the audio signal.

Further, in the first embodiment, the correction function is a polynomial function with respect to a variable of the frequency.

In this way, adjusting the order M of the polynomial function permits a degree of gradual variation in the correction coefficient f, relative to variation in the frequency to be adjusted.

In addition, in the first embodiment, the signal correction apparatus 1 is adapted to estimate the correction function from the first time-averaged power x, that is an average of the varied values of the power $x_i(t)$ computed on a controlled number of the frame signals and the second time-averaged power $y_i$ that is another average of the varied values of the power $y_i$ computed on the frame signals.

In this manner, sound converted into an audio signal on which the first time-averaged power $x_i$ is computed and that on which the second time-averaged power $y_i$ is computed can be conformed as much as possible. As a consequence, the first power $x_i(t)$ of the audio signal, when corrected, can be fully approximated to the reference power $y_i(t)$.

Also, configured as discussed so far, the signal correction apparatus can alleviate adverse effects of noise on the sound even if the sound emitted from a sound source is superimposed with noise for only a relatively short duration. Thus, the first power $x_i(t)$ can be approximated to the reference power $y_i(t)$ with the enhanced precision.

Figure 3:
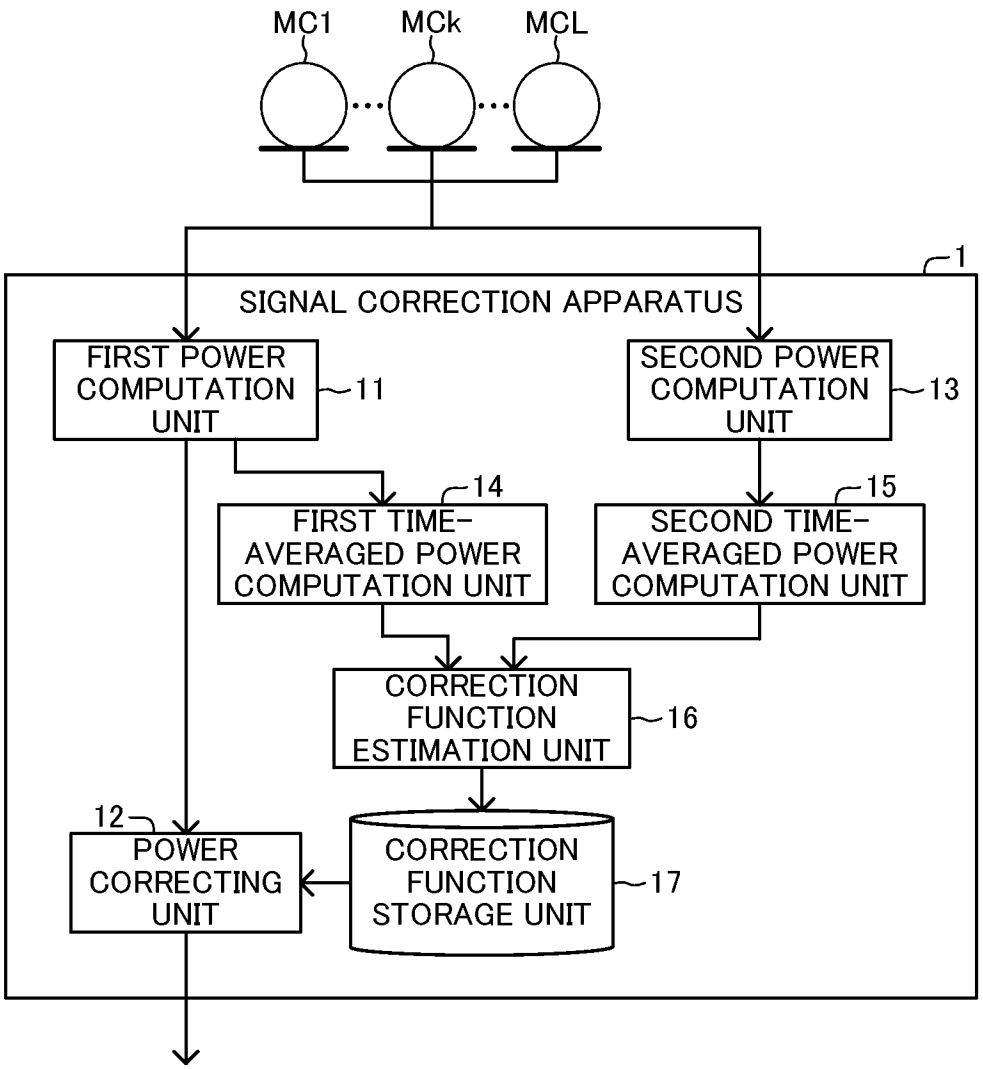
FIG. 3 is a schematic block diagram illustrating various functions of a modified version of the first embodiment of signal correction apparatus according to the present invention.

In the above-mentioned modified version of the first embodiment, based upon an audio signal received via each of the microphones MC1 to MCL, the second power computation unit 13 computes, at every frequency, power that indicates magnitude of sound represented by the audio signal, and it further computes as the second power $y_i(t)$ an average of values of the power computed respectively for the microphones MC1 to MCL (see FIG. 3).

Embodiment 2

Figure 4:
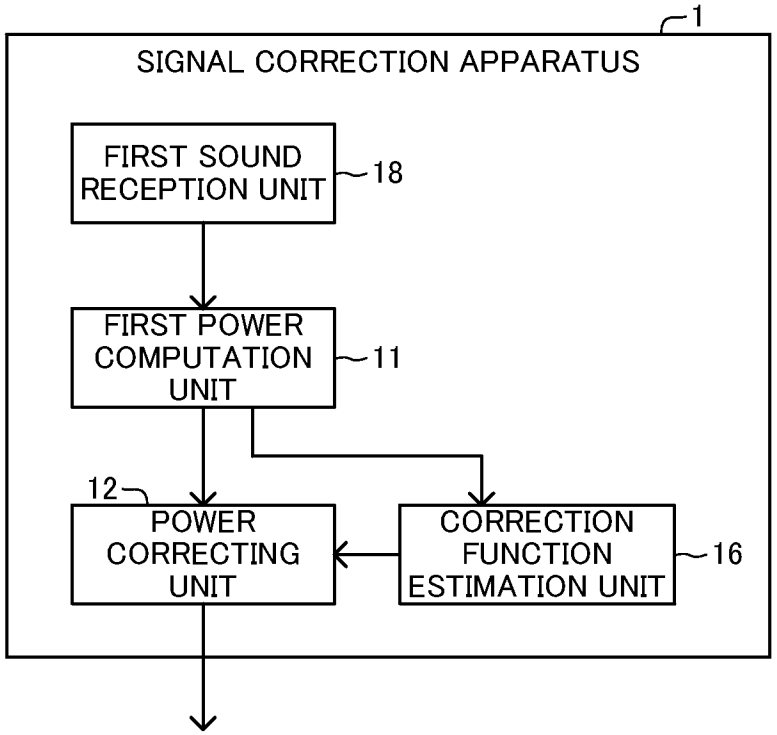
FIG. 4 is a schematic block diagram illustrating various functions of a second embodiment of the signal correction apparatus according to the present invention.

Then, a second embodiment of the signal correction apparatus according to the present invention will be described with reference to FIG. 4.

The signal correction apparatus 1 in the second embodiment has function means such as a first power computation unit (first power computation means) 11, a power correcting unit (power correcting means) 12, a correction function estimation unit (correction function estimation means) 16, and a first sound reception unit (first sound reception means) 18

The sound reception means 18 receives an input audio signal.

Based upon the audio signal received by the first sound reception means 18, the input power computation unit 11 computes, at every frequency, first power that indicates magnitude of sound represented by the audio signal.

The correction function estimation unit 16 estimates, at every frequency, a correction function that is a continuous function defining a relation between each frequency and a correction coefficient used to approximate the first power computed by the first power computation unit 11 at that frequency to the reference power predetermined for that frequency.

The input power correcting unit 12 performs an operation of multiplying the input power produced from the input power computation unit 11 by the correction coefficient acquired in accordance with the relation defined by the correction function estimated by the correction function estimation unit 16 so as to correct the power at every frequency.

In this manner, the signal correction apparatus 1 estimates a correction function defining a relation between each frequency and the correction coefficient and multiplies a value of power indicating magnitude of sound represented by the input audio signal (i.e., the power of the audio signal) by the correction coefficient predetermined from the estimated correction function so as to correct the input power.

In this way, even if the input audio signal has power excessively greater (or smaller) at a certain frequency than at any other frequency for some reason or other, the power (first power) of the audio signal can be fully approximated to the reference power.

Thus, configured as in the aforementioned manner, the signal correction apparatus is capable of correcting the power of the input audio signal so as to precisely approximate the power of the audio signal to the reference power.

In this case, the correction function is preferably a polynomial function with respect to a variable of the frequency.

In this way, adjusting the order of the polynomial function permits a degree of gradual variation in the correction coefficient relative to variation in the frequency to be adjusted.

In this case, the correction function estimation means is preferably adapted to estimate the correction function according to which the sum of all the values, over a predetermined frequency range, resulting from squaring the difference between the corrected first power and the reference power is minimal.

In this manner, it is possible to enlarge the frequency range that enables the power of the received audio signal to fully approximate to the reference power.

In this case, the signal correction apparatus is preferably configured to comprises:

a second sound reception means for receiving an input audio signal, and a second power computation means for computing, at every frequency, second power that indicates magnitude of sound represented by an audio signal received by the second sound reception means; and the correction function estimation means uses the computed second power as the reference power.

In this manner, the power of the audio signal received by the first sound reception means can fully approximate to the power (reference power) of the audio signal received by the second sound reception means.

In this case, the first power computation means divides the audio signal received by the first sound reception means into signal fragments of a predetermined frame interval, and computes the first power for each of the signal fragments at every frequency;

the second power computation means divides the audio signal received by the second sound reception means into signal fragments of a predetermined frame interval, and computes the second power for each of the signal fragments at every frequency;

the signal correction apparatus further comprises a first time-averaged power computation means for computing first time-averaged power that is an average of all the values of the first power for each of the signal fragments of the audio signal computed by the first power computation means, and a second time-averaged power computation means for computing second time-averaged power that is an average of all the values of the second power for each of the signal fragments of the audio signal computed by the second power computation means; and the correction function estimation means is adapted to estimate the correction function that defines a relation between each frequency and a correction coefficient used to approximate the first time-averaged power computed at that frequency to the second time-averaged power computed at that frequency.

When a distance from the first sound reception means (e.g., microphones) to a sound source from which the sound converted into the audio signal is emitted is relatively greatly varied from the distance from the second sound reception means to the same sound source, a delay time associated with propagation of the sound from the sound source to each of the first and second sound reception means is relatively greatly varied from one means to another.

Thus, when, at a certain point of time, the first sound reception means receives a first audio signal while the second sound reception means receives a second audio signal, the sound that is to be converted into the first audio signal and the same sound that is to be converted into the second audio signal would be perceived as being different from each other.

Also, when time required to transmit the audio signal from the first sound reception means to the signal correction apparatus and that from the second sound reception means to the signal correction apparatus are relatively greatly different, the sound received through the first sound reception means and converted into the first audio signal and the same sound received through the second sound reception means and converted into the second audio signal would also be perceived as being different from each other.

In this case, configured to estimate the correction function for the audio signal only at a certain point of time of its duration, the signal correction apparatus cannot fully approximate the power of the audio signal received by the first sound reception means to the power (reference power) of the audio signal received by the second sound reception means.

In comparison, the signal correction apparatus in this embodiment is adapted to conform to a greater degree the sound that is received by the first and second sound reception means and is to be converted into the audio signal on which the time-averaged power is computed respectively. As a consequence, the power of the audio signal received by the first sound reception means, when corrected, permits itself to be fully approximated to the reference power.

In the aforementioned manner, even if the sound emitted from the sound source is superimposed with noise for a relatively short duration, adverse effects of the noise can be alleviated. Thus, the power of the audio signal received by the first sound reception means can be approximated to the reference power with the enhanced precision.

In such a case, preferably, the signal correction apparatus comprises a plurality of the sound reception means for receiving an input audio signal; and the second power computation means is adapted to, for each of the plurality of the sound reception means, compute power that indicates magnitude of sound represented by the audio signal received by the sound reception means and compute as the second power an average of all the values of the power computed for each of the plurality of the sound reception means.

In another embodiment of the signal correction apparatus, the correction function estimation means is preferably adapted to take a value stored in advance as the reference power.

In this case, the correction function estimation means is adapted to estimate a correction function when the sound represented by the audio signal received by the first sound reception means is white noise.

Moreover, a signal correction method in another embodiment according to the present invention comprises:

computing, at every frequency, first power that indicates magnitude of sound represented by an audio signal, based upon the audio signal received by a first sound reception means for receiving an input audio signal, estimating a correction function that is a continuous function defining a relation between each frequency and a correction coefficient used to approximate the computed first power at that frequency to the reference power predetermined for that frequency, and multiplying the computed input power by the correction coefficient obtained in accordance with the relation defined by the estimated correction function, for correcting the first power at every frequency.

In this case, the correction function is preferably a polynomial function with regard to a variable of the frequency range.

Also, in the signal sound correction method, the step of estimating a correction function preferably includes estimating the correction function according to which the sum of all the values, over a predetermined frequency range, resulting from squaring the difference between the corrected input power and the reference is minimal.

A signal correction program in still another embodiment according to the present invention comprises instructions for causing an information processing device to realize:

a first power computation means for computing, at every frequency, first power that indicates magnitude of sound represented by an audio signal, based upon the audio signal received by a first sound reception means for receiving an input audio signal, a correction function estimation means for estimating a correction function that is a continuous function defining a relation between a certain frequency and a correction coefficient used to approximate the computed input power at that frequency to the reference power predetermined for that frequency, a power correcting means multiplying the computed input power by the correction coefficient obtained in accordance with the relation defined by the estimated correction function, for correcting the input power at every frequency.

In this case, the correction function is preferably a polynomial function with regard to a variable of the frequency.

In this case, the correction function estimation means for estimating a correction function is preferably adapted to estimate the correction function according to which the sum of all the values resulting from squaring the difference between the corrected input power and the reference power over a predetermined frequency range is minimal.

Besides the invention configured as mentioned above, an invention implemented in the signal correction method or the signal correcting program can be effective similar to the implementation of the signal correction apparatus and can attain the aforementioned object of the present invention.

Although the present invention has been described so far in the context of the embodiments as mentioned above, the present invention should not be limited to the precise forms as discussed above. Any of the arrangements and particulars in the present invention is modifiable in variations that any person having ordinary skills in the art without departing from the true scope of the present invention.

In one modified version of the aforementioned embodiment, the correction function estimation means 16 may be adapted to use a value stored in advance in a data storage device as the reference power $y_1$.

In this version of the embodiment, the correction function estimation unit 16 is adapted to estimate the correction function only when the sound represented by the received audio signal is white noise, the correction function may alternatively be estimated when the sound represented by the received audio signal is any of predetermined types of sound other than white noise.

In a further modified version of the embodiment, any combination of the aforementioned embodiments and their respective modified versions may be employed.

Although, in each of the embodiments, the program is stored in the data storage device, it may be stored in a computer-readable data storage medium. The data storage medium includes, for example, flexible disks, optical disks, magneto-optical disks, semiconductor memories, and any other portable media.

The present invention claims the benefit of the priority based on the Patent Application No. 2008-302243 filed on Nov. 27, 2008 in Japan, which is in its entirety incorporated herein by reference.

INDUSTRIAL APPLICABILITY

The present invention is applicable to applications, such as sound signal processing systems, having a plurality of microphones for receiving an audio signal input via each of the microphones.

DESCRIPTION OF REFERENCE SYMBOLS

1 Signal Correction Apparatus
11 First Power Computation Unit
12 Power Correcting Unit
13 Second Power Computation Unit
14 First Time-Averaged Power Computation Unit
15 Second Time-Averaged Power Computation Unit
16 Correction Function Estimation Unit
17 Correction Function Storage Unit
18 First Sound Reception Unit
MC1 to MCL Microphones
MCR Microphone

The invention claimed is:

1. A signal correction apparatus comprising:

a first sound reception unit for receiving an input audio signal;

a first power computation unit for computing, at every frequency, first power that indicates magnitude of sound represented by an audio signal, based upon the audio signal received by the first sound reception unit;

a correction function estimation unit for estimating a correction function that is a continuous function defining a relation between each frequency and a correction coefficient used to approximate the computed first power at that frequency to a reference power predetermined for that frequency; and a power correcting unit multiplying the computed first power by the correction coefficient obtained in accordance with the relation defined by the estimated correction function, for correcting the first power at every frequency;

wherein the correction function is a polynomial function with regard to a variable of the frequency, of which order is changeable.

2. The signal correction apparatus according to claim 1, wherein the correction function estimation unit is adapted to estimate the correction function according to which the sum of all the values, over a predetermined frequency range, resulting from squaring the difference between the corrected first power and the reference power is minimal.

3. The signal correction apparatus according to claim 1, further comprising:

a second sound reception unit for receiving an input audio signal; and a second power computation unit for computing, at every frequency, second power that indicates magnitude of sound represented by an audio signal, based upon the audio signal received by the second sound reception unit;

wherein the correction function estimation unit is adapted to use the computed second power as the reference power.

4. The signal correction apparatus according to claim 3, wherein the first power computation unit is adapted to divide the audio signal received by the first sound reception unit into signal fragments of a predetermined frame interval and to compute the first power for each of the signal fragments at every frequency;

wherein the second power computation unit is adapted to divide the audio signal received by the second sound reception unit into signal fragments of a predetermined frame interval and to compute the second power for each of the signal fragments at every frequency;

wherein the signal correction apparatus further comprises:

i) a first time-averaged power computation unit for computing first time-averaged power that is an average of all the values of the first power for each of the signal fragments of the audio signal computed by the first power computation unit; and ii) a second time-averaged power computation unit for computing second time-averaged power that is an average of all the values of the second power for each of the signal fragments of the audio signal computed by the second power computation unit; and wherein the correction function estimation unit is adapted to estimate the correction function that defines a relation between each frequency and a correction coefficient used to approximate the first time-averaged power computed at that frequency to the second time-averaged power computed at that frequency.

5. The signal correction apparatus according to claim 3, further comprising:

a plurality of sound reception units for receiving an input audio signal; and wherein the second power computation unit is adapted to, for each of the plurality of sound reception unit, compute power that indicates magnitude of sound represented by the audio signal received by the sound reception unit, and to compute as the second power an average of all the values of the power computed for each of the plurality of sound reception unit.

6. The signal correction apparatus according to claim 1, wherein the correction function estimation unit is adapted to use a value stored in advance as the reference power.

7. The signal correction apparatus according to claim 1, wherein the correction function estimating unit is adapted to estimate the correction function when the sound represented by the audio signal received by the first sound reception unit is white noise.

8. A signal correction method comprising:

computing, at every frequency, first power that indicates magnitude of sound represented by an audio signal, based upon the audio signal received by a first sound reception unit for receiving an input audio signal;

estimating a correction function that is a continuous function defining a relation between each frequency and a correction coefficient used to approximate the computed first power at that frequency to a reference power predetermined for that frequency; and multiplying the computed first power by the correction coefficient obtained in accordance with the relation defined by the estimated correction function, for correcting the first power at every frequency;

wherein the correction function is a polynomial function with regard to a variable of the frequency, of which order is changeable.

9. The signal correction method according to claim 8, wherein the step of estimating includes estimating the correction function according to which the sum of all the values, over a predetermined frequency range, resulting from squaring the difference between the corrected first power and the reference power is minimal.

10. A non-transitory computer-readable medium storing a signal correcting program comprising instructions for causing an information processing device to realize:

a first power computation unit for computing, at every frequency, first power that indicates magnitude of sound represented by an audio signal, based upon the audio signal received by a first sound reception unit for receiving an input audio signal;

a correction function estimation unit for estimating a correction function that is a continuous function defining a relation between each frequency and a correction coefficient used to approximate the computed first power at that frequency to a reference power predetermined for that frequency; and a power correcting unit multiplying the computed first power by the correction coefficient obtained in accordance with the relation defined by the estimated correction function, for correcting the first power at every frequency;

wherein the correction function is a polynomial function with regard to a variable of the frequency, of which order is changeable.

11. The non-transitory computer-readable medium according to claim 10, wherein the correction function estimation unit is adapted to estimate the correction function according to which the sum of all the values, over a predetermined frequency range, resulting from squaring the difference between the corrected first power and the reference power is minimal.

12. A signal correction apparatus comprising:

a first sound reception means for receiving an input audio signal;

a first power computation means for computing, at every frequency, first power that indicates magnitude of sound represented by an audio signal, based upon the audio signal received by the first sound reception means;

a correction function estimation means for estimating a correction function that is a continuous function defining a relation between each frequency and a correction coefficient used to approximate the computed first power at that frequency to a reference power predetermined for that frequency; and a power correcting means multiplying the computed first power by the correction coefficient obtained in accordance with the relation defined by the estimated correction function, for correcting the first power at every frequency;

wherein the correction function is a polynomial function with regard to a variable of the frequency, of which order is changeable.

* * * * *

UNITED STATES PATENT AND TRADEMARK OFFICE

CERTIFICATE OF CORRECTION

PATENT NO. : 8,842,843 B2
APPLICATION NO. : 13/129646
DATED : September 23, 2014
INVENTOR(S) : Tadashi Emori and Masanori Tsujikawa It is certified that error appears in the above-identified patent and that said Letters Patent is hereby corrected as shown below:

In the Specification

Column 6, Line 9: Delete "vector" and insert -- vector $a=(a_M,...a_1, a_0)^T$ --

In the Claims

Column 13, Line 64: In Claim 5, delete "signal; and" and insert -- signal; --

Signed and Sealed this
Twenty-fourth Day of March, 2015

Michelle K. Lee

Michelle K. Lee
*Director of the United States Patent and Trademark Office*